US009435623B2

(12) United States Patent
Rastegar

(10) Patent No.: US 9,435,623 B2
(45) Date of Patent: Sep. 6, 2016

(54) COMPACT AND LOW-VOLUME MECHANICAL IGNITER AND IGNITION SYSTEMS WITH SAFING ARM AND ARMING PIN FOR THERMAL BATTERIES AND THE LIKE

(71) Applicant: Jahangir S Rastegar, Stony Brook, NY (US)

(72) Inventor: Jahangir S Rastegar, Stony Brook, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 151 days.

(21) Appl. No.: 13/621,288

(22) Filed: Sep. 16, 2012

(65) Prior Publication Data

US 2014/0076185 A1 Mar. 20, 2014

(51) Int. Cl.
*F42C 15/20* (2006.01)
*F42C 15/24* (2006.01)

(52) U.S. Cl.
CPC ..... *F42C 15/20* (2013.01); *F42C 15/24* (2013.01)

(58) Field of Classification Search
CPC ..... F42C 15/20–15/24; F42C 15/34
USPC ..... 102/222, 258, 260, 202.1
See application file for complete search history.

(56) References Cited

U.S. PATENT DOCUMENTS 1,327,488 A * 1/1920 McNulty ..... F42C 15/20 102/418
1,428,203 A * 9/1922 Asbury ..... F42C 15/22 102/243
1,655,591 A * 1/1928 Brayton ..... F42C 15/22 102/242
1,655,653 A * 1/1928 Kowolchuk ..... 102/256
2,378,626 A * 6/1945 Fanger ..... F42C 15/20 102/247
3,106,893 A * 10/1963 Brandt ..... 102/253
3,279,374 A * 10/1966 Parker et al. ..... 102/365
3,286,634 A * 11/1966 Weber ..... F42C 9/041 102/249
3,557,701 A * 1/1971 Arnell ..... F42C 1/04 102/205
3,814,018 A * 6/1974 Daniel ..... F42C 15/24 102/253
3,981,239 A * 9/1976 Czajkowski et al. ..... 102/393
4,827,846 A * 5/1989 Smolnik ..... F42C 15/20 102/256
6,269,746 B1 * 8/2001 Larsen ..... 102/262
2008/0110365 A1 * 5/2008 Rastegar et al. ..... 102/204
2010/0071577 A1 * 3/2010 Rastegar ..... F42C 15/24 102/216

* cited by examiner

*Primary Examiner* — Stephen M Johnson
*Assistant Examiner* — Benjamin Gomberg

(57) ABSTRACT

A method for actuating an inertial igniter. The method including: moving a mass contained within an interior of a body towards one of a pyrotechnic material or primer when an all-fire acceleration profile is experienced; hermetically sealing the interior of the body from an outside environment; restraining the movable mass from contacting the one of the pyrotechnic material or primer for acceleration profiles less than the all-fire acceleration profile; at least indirectly blocking the movable mass from movement towards the one of the pyrotechnic material or primer under acceleration profiles equal to or greater than the all-fire acceleration profile; and manually removing the blocking such that the movable mass can move towards and contact the one of the pyrotechnic material or primer when the all-fire acceleration profile is experienced to actuate the inertial igniter.

16 Claims, 13 Drawing Sheets

COMPACT AND LOW-VOLUME MECHANICAL IGNITER AND IGNITION SYSTEMS WITH SAFING ARM AND ARMING PIN FOR THERMAL BATTERIES AND THE LIKE

BACKGROUND OF THE INVENTION

1. Field of the Invention

The present disclosure relates generally to inertial igniters and more particularly to inertial igniters for thermal batteries or other pyrotechnic type initiated devices for munitions such as gun fired or mortar rounds or rockets with safety arm.

2. Prior Art

Thermal batteries represent a class of reserve batteries that operate at high temperature. Unlike liquid reserve batteries, in thermal batteries the electrolyte is already in the cells and therefore does not require a distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use. Reserve batteries are inactive and inert when manufactured and become active and begin to produce power only when they are activated.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape. Thermal batteries, however, have the advantage of very long shelf life of up to 20 years that is required for munitions applications.

Thermal batteries generally use some type of igniter (initiator) to provide a controlled pyrotechnic reaction to produce output gas, flame or hot particles to ignite the heating elements of the thermal battery.

There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operates based on the firing acceleration. These (mechanical) inertial igniters do not require onboard batteries for their operation and are thereby often used in high-G munitions applications such as in gun-fired munitions and mortars.

In munitions, the need to differentiate accidental and initiation accelerations, i.e., the so-called no-fire and all-fire (set-back) accelerations, respectively, by the resulting impulse level of the event necessitates the employment of a safety system which is capable of allowing initiation of the igniter only during high total impulse levels. In mechanical inertial igniters, the safety mechanism can be thought of as a mechanical delay mechanism, after which a separate initiation system is actuated or released to provide ignition of the pyrotechnics. Such mechanical inertial igniters that combines such a safety system with an impact based initiation system of different types are described, for example, in U.S. Pat. Nos. 7,437,995; 7,587,979; 7,587,980; 7,832,335; 8,042,469; and 8,061,271; U.S. Patent Application Publication Nos. 2010/0307362; 2011/0171511; 2012/0180680; 2012/0180681; 2012/0180682; 2012/0205225 and 2012/0210896 and U.S. patent application Ser. Nos. 12/794,763; 12/955,876 and 13/180,469; the disclosures or each of which are incorporated by reference.

Inertia-based (mechanical) igniters must therefore comprise two components so that together they provide the aforementioned mechanical safety (delay mechanism) and to provide the required striking action to achieve ignition of the pyrotechnic elements. The function of the safety system is to fix the striker in position until a specified acceleration time profile actuates the safety system and releases the striker, allowing it to accelerate toward its target under the influence of the remaining portion of the specified acceleration time profile. The ignition itself may take place as a result of striker impact, or simply contact or proximity. For example, the striker may be akin to a firing pin and the target akin to a standard percussion cap primer. Alternately, the striker-target pair may bring together one or more chemical compounds whose combination with or without impact will set off a reaction resulting in the desired ignition.

As an example, the isometric cross-sectional view of an inertial igniter described in U.S. Patent Application Publication No. 2011/0171511 is shown in FIG. 1, referred to generally with reference numeral 200. The full isometric view of the inertial igniter 200 is shown in FIG. 2. The inertial igniter 200 is constructed with igniter body 201, consisting of a base 202 and at least three posts 203. The base 202 and the at least three posts 203, can be integrally formed as a single piece but may also be constructed as separate pieces and joined together, for example by welding or press fitting or other methods commonly used in the art. The base 202 of the housing can also be provided with at least one opening 204 (with a corresponding opening(s) in the thermal battery—not shown) to allow ignited sparks and fire to exit the inertial igniter and enter into the thermal battery positioned under the inertial igniter 200 upon initiation of the inertial igniter pyrotechnics 215, or initiation of a percussion cap primer when used in place of the pyrotechnics.

A striker mass 205 is shown in its locked position in FIG. 1. The striker mass 205 is provided with guides for the posts 203, such as vertical surfaces 206, that are used to engage the corresponding (inner) surfaces of the posts 203 and serve as guides to allow the striker mass 205 to ride down along the length of the posts 203 without rotation with an essentially pure up and down translational motion.

In its illustrated position in FIGS. 1 and 2, the striker mass 205 is locked in its axial position to the posts 203 by at least one setback locking ball 207. The setback locking ball 207 locks the striker mass 205 to the posts 203 of the inertial igniter body 201 through the holes 208 provided in the posts 203 and a concave portion such as a dimple (or groove) 209 on the striker mass 205 as shown in FIG. 1. A setback spring 210, which is preferably in compression, is also provided around but close to the posts 203 as shown in FIGS. 1 and 2. In the configuration shown in FIG. 1, the locking balls 207 are prevented from moving away from their aforementioned locking position by the collar 211. The setback spring 210 can be a wave spring with rectangular cross-section. The rectangular cross-section eliminates the need to fix or otherwise retain the striker spring 210 to the collar 211, which is an expensive process; the flat coil spring surfaces minimizes the chances of coils slipping laterally (perpendicular to the direction of acceleration 218), which can cause jamming and prevent the release of the striker mass 205 (preventing the collar to move down enough to release the locking balls). Furthermore, wave springs generate friction between the waves at contact points along the spring wire, thereby reducing the chances for the collar 211 to rapidly bounce back up and preventing the striker mass 205 from being released.

The collar 211 is preferably provided with partial guide 212 ("pocket"), which are open on the top as indicated by the numeral 213. The guide 212 may be provided only at the location of the locking balls 207 as shown in FIGS. 1 and 2, or may be provided as an internal surface over the entire inner surface of the collar 211. The advantage of providing local guides 212 is that it results in a significantly larger surface contact between the collar 211 and the outer surfaces of the posts 203, thereby allowing for smoother movement of the collar 211 up and down along the length of the posts 203. In addition, they prevent the collar 211 from rotating relative to the inertial igniter body 201 and make the collar stronger.

The collar 211 rides up and down on the posts 203 as can be seen in FIGS. 1 and 2, but is biased to stay in its upper most position as shown in FIGS. 1 and 2 by the setback spring 210. The guides 212 are provided with bottom ends 214, so that when the inertial igniter is assembled as shown in FIGS. 1 and 2, the setback spring 210 which is biased (preloaded) to push the collar 211 upward away from the igniter base 202, would "lock" the collar 211 in its uppermost position against the locking balls 207. As a result, the assembled inertial igniter 200 stays in its assembled state and would not require a top cap to prevent the collar 211 from being pushed up and allowing the locking balls 207 from moving out and releasing the striker mass 205.

In the embodiment 200, a one part pyrotechnics compound 215 (such as lead styphnate or other similar compound) can be used as shown in FIG. 1. The striker mass can be provided with a relatively sharp tip 216 and the igniter base surface 202 is provided with a protruding tip 217 which is covered with the pyrotechnics compound 215, such that as the striker mass is released during an all-fire event and is accelerated down (opposite to the arrow 218 illustrated in FIG. 1), impact occurs mostly between the surfaces of the tips 216 and 217, thereby pinching the pyrotechnics compound 215, thereby providing the means to obtain a reliable initiation of the pyrotechnics compound 215. Alternatively, a two-part pyrotechnics, e.g., potassium chlorate (first part), can be provided on the base 202 over the exit hole 204 and a second part consisting of red phosphorus can be provided on the lower surface of the striker mass surface 205 over the area of the sharp tip 216.

Alternatively, instead of using the pyrotechnics compound 215, FIG. 1, a percussion cap primer or the like can be used. A striker tip is generally provided at the tip 216 of the striker mass 205 to facilitate initiation upon impact.

The basic operation of the embodiment 200 of the inertial igniter of FIGS. 1 and 2 is as follows. If the inertial igniter is subjected to any non-trivial acceleration in the axial direction 218 which can cause the collar 211 to overcome the resisting force of the setback spring 210 will initiate and sustain some downward motion of the collar 211. The force due to the acceleration on the striker mass 205 is supported at the dimples 209 by the locking balls 207 which are constrained inside the holes 208 in the posts 203. If an acceleration amplitude and duration in the axial direction 218 imparts a sufficient impulse (i.e., an impulse greater than a predetermined threshold) to the collar 211, it will translate down along the axis of the assembly until the setback locking balls 205 are no longer constrained to engage the striker mass 205 to the posts 203. If the acceleration event is not sufficient to provide this motion (i.e., the acceleration time profile provides less impulse than the predetermined threshold), the collar 211 will return to its start (top) position under the force of the setback spring 210.

Assuming that the acceleration time profile was at or above the specified "all-fire" profile, the collar 211 will have translated down past the locking balls 207, allowing the striker mass 205 to accelerate down towards the base 202. In such a situation, since the locking balls 207 are no longer constrained by the collar 211, the downward force that the striker mass 205 has been exerting on the locking balls 207 will force the locking balls 207 to move outward in the radial direction. Once the locking balls 207 are out of the way of the dimples 209, the downward motion of the striker mass 205 is no longer impeded. As a result, the striker mass 205 is accelerated downward, causing the tip 216 of the striker mass 205 to strike the pyrotechnic compound 215 on the surface of the protrusion 217 with the requisite energy to initiate ignition.

In the embodiment 200 of the inertial igniter shown in FIGS. 1 and 2, the setback spring 210 is illustrated as a helical wave spring type fabricated with rectangular cross-sectional wires (such as the ones manufactured by Smalley Steel Ring Company of Lake Zurich, Ill.). The use of such rectangular cross-section wave springs or the like has the following significant advantages over helical springs that are constructed with wires with circular cross-sections. Firstly and most importantly, as the spring is compressed and nears its "solid" length, the flat surfaces of the rectangular cross-section wires come in contact and generate minimal lateral forces that would otherwise tend to force one coil to move laterally relative to the other coils as is usually the case when the wires are circular in cross-section. Lateral movement of the coils can, in general, interfere with the proper operation of the inertial igniter since it could, for example jam a coil to the outer housing of the inertial igniter (not shown), which is usually desired to house the igniter 200 or the like with minimal clearance to minimize the total volume of the inertial igniter. In addition, the laterally moving coils could also jam against the posts 203 thereby further interfering with the proper operation of the inertial igniter. The use of such wave springs with rectangular cross-section eliminates such lateral movement and therefore significantly increases the reliability of the inertial igniter and also significantly increases the repeatability of the initiation for a specified all-fire condition. The second advantage of the use of the aforementioned wave springs with rectangular cross-section, particularly since the wires can and are usually made thin in thickness and relatively wide, the solid length of the resulting wave spring can be made to be significantly less than an equivalent regular helical spring with circular cross-section. As a result, the total height of the resulting inertial igniter can be reduced. Thirdly, since the coil waves are in contact with each other at certain points along their lengths and as the spring is compressed, the length of each wave is slightly increased, therefore during the spring compression the friction forces at these contact points do a certain amount of work and thereby absorb a certain amount of energy. The presence of such friction forces ensures that the firing acceleration and very rapid compression of the spring would to a lesser amount tend to "bounce" the collar 211 back up and thereby increasing the possibility that it would interfere with the exit of the locking balls from the dimples 209 of the striker mass 205 and the release of the striker mass 205. The above characteristic of the wave springs with rectangular cross-section therefore also significantly enhances the performance and reliability of the inertial igniter 200 while at the same time allowing its height (and total volume) to be reduced.

In the prior art inertial igniters similar the one illustrated in FIGS. 1 and 2, by varying the mass of the striker 205, the mass of the collar 211, the spring rate of the setback spring 210, the distance that the collar 211 has to travel downward to release the locking balls 207 and thereby release the striker mass 205, and the distance between the tip 216 of the striker mass 205 and the pyrotechnic compound 215 (and the tip of the protrusion 217), the designer of the disclosed inertial igniter 200 can match the all-fire and no-fire impulse level requirements for various applications as well as the safety (delay or dwell action) protection against accidental dropping of the inertial igniter and/or the munitions or the like within which it is assembled.

Briefly, the safety system parameters, i.e., the mass of the collar 211, the spring rate of the setback spring 210 and the dwell stroke (the distance that the collar 210 has to travel downward to release the locking balls 207 and thereby release the striker mass 205) must be tuned to provide the required actuation performance characteristics. Similarly, to provide the requisite impact energy, the mass of the striker 205 and the aforementioned separation distance between the tip 216 of the striker mass and the pyrotechnic compound 215 (and the tip of the protrusion 217) must work together to provide the specified impact energy to initiate the pyrotechnic compound when subjected to the remaining portion of the prescribed initiation acceleration profile after the safety system has been actuated.

The inertial igniters of the type described above have been shown to be capable of being miniaturized and provide highly reliable means of initiating thermal batteries or the like. In certain applications, particularly in applications in which the firing (setback) acceleration for initiating the thermal battery is relatively low and/or its duration is relatively short, then the acceleration levels that the inertial igniter could accidentally be subjected to might be even higher than the intended all-fire (setback) acceleration and/or duration. This would also be the case if the munitions in which the inertial igniter is used are required to survive shock loading due to drops from relatively high heights of the order of 40 feet or nearby explosions without the thermal battery (inertial igniter) initiation. In such situations, the aforementioned safety mechanisms would not prevent inertial igniter initiation since shock impulse that could be experienced by the inertial igniter could be higher than that of the firing setback. In such applications, it is highly desirable to provide the inertial igniter integrated thermal battery with safing arm (pin) that has to be removed (actuated or inserted or the like) to make the inertial igniter operational in response to the prescribed all-fire shock profile.

SUMMARY OF THE INVENTION

A need therefore exists for novel miniature inertial igniters for thermal batteries used in munitions such as certain gun fired and mortar rounds and rockets, which require safing arms (pins) to prevent them from being accidentally initiated by dropping or nearby explosions or the like relatively high and long duration shock loading. The innovative inertial igniters can be scalable to thermal batteries of various sizes. Such inertial igniters must be safe in general and in particular they should not initiate when subjected to certain prescribed no-fire shock loading profile; should not initiate with the safing arm (pin) on; should be able to be designed for high firing accelerations, for example up to 20-50,000 Gs or higher; and should be able to be designed to ignite (initiate) at specified acceleration levels when subjected to such accelerations for a specified amount of time as specified by the firing (all-fire) acceleration profile. Reliability is also of much concern since the rounds should have a shelf life of up to 20 years and could generally be stored at temperatures of sometimes in the range of −65 to 165 degrees F. This requirement is usually satisfied best if the igniter pyrotechnic is in a sealed compartment. The inertial igniters must also consider the manufacturing costs and simplicity in design to make them cost effective for munitions applications.

Accordingly, inertial igniters and ignition systems for use with thermal batteries or the like that are equipped with safing arms (pins) that when in place would prevent the inertial igniter and thereby the thermal battery from being activated are provided. In the disclosed embodiments of the present invention, the basic method used to provide the inertial igniters with safe arming capability is based on using certain mechanisms that in the presence of the "safing arms" (pins), the full operation of the aforementioned safety mechanism (delay mechanism) in releasing the striker mass is prevented by mechanical interference, i.e., by providing stops in the path of movement of the safety (striker release) mechanism. Thereby, even if the inertial igniter is subjected to the prescribed all-fire (or higher) acceleration time profile, the safing arm would prevent the safety mechanism from releasing the striker mass, thereby preventing the inertial igniter from activation.

The disclosed safing arm equipped inertial igniter embodiments of the present invention have the following highly desirable characteristics:

- They provide hermetically sealed inertial igniters that are readily integrated with thermal batteries to form a hermetically sealed thermal battery;
- The safing arm (pin) will prevent inertial igniter activation even when it is subjected to acceleration levels that are significantly higher than the all-fire acceleration levels even if the applied acceleration duration is also infinitely long;
- The safing arm (pin) can be readily removed to make the inertial igniter, thereby the thermal battery, operational;
- Once the safing arm is removed, the safing arm mechanism does not interfere with proper and reliable operation of the inertial igniter.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

The aforementioned inertia-based (mechanical) igniters were shown to comprise of two basic components (mechanisms) and together they provide the aforementioned mechanical safety (delay mechanism) and provide the required striking action to achieve ignition of the pyrotechnic elements. As it was previously described, the function of the safety system (mechanism) is to fix the striker in position until a specified acceleration time profile actuates the safety mechanism and releases the striker, allowing it to accelerate toward its target under the influence of the remaining portion of the specified acceleration time profile. The ignition itself may take place as a result of striker impact, or rubbing action or simply contact or proximity. For example, the striker may be akin to a firing pin and the target akin to a standard percussion cap primer.

The following embodiments operate based on the use of certain type of mechanisms that are actuated by the provided safing arm (pin) to prevent the aforementioned mechanical safety (delay) mechanism to fully operate, thereby preventing the striker element of the inertial igniter to be released (become operational) for the required striking action to achieve ignition of the pyrotechnic elements. In the following, the different safing arm embodiments, their methods of design and their operation are described using the prior art inertial igniter of FIGS. 1 and 2.

Figure 1:
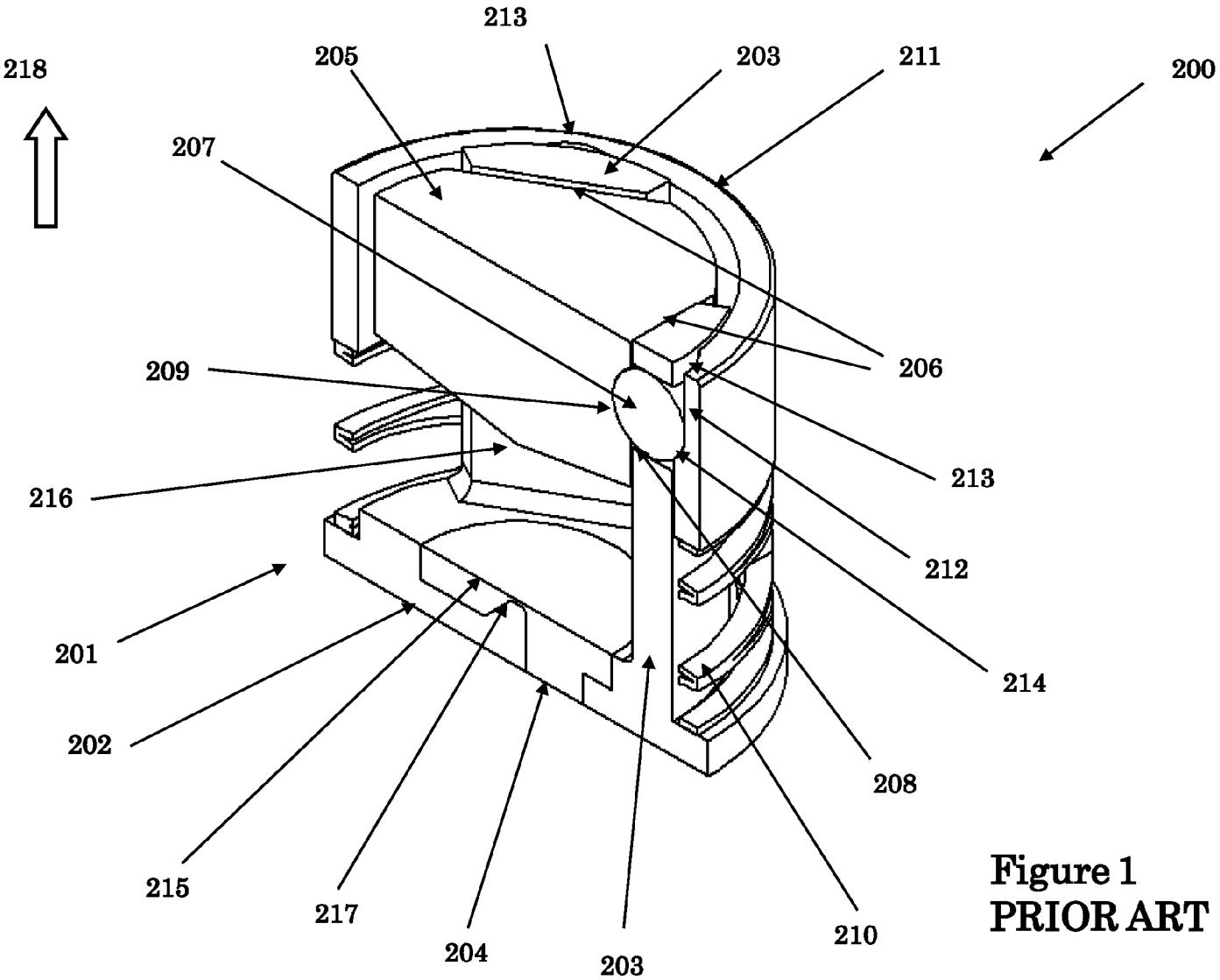
Figure 1 PRIOR ART
FIG. 1 illustrates an isometric cut away view of an inertial igniter assembly known in the art.
Figure 2:
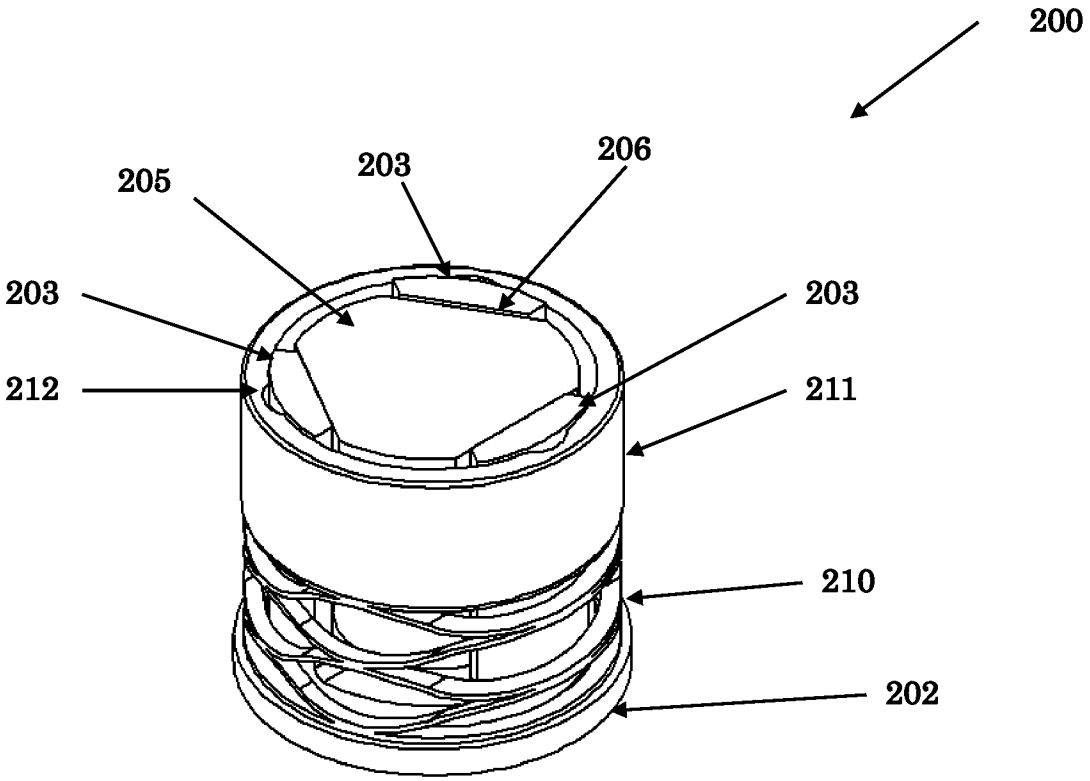
Figure 2 PRIOR ART
FIG. 2 illustrates a full isometric view of the inertial igniter assembly of FIG. 1.
Figure 3:
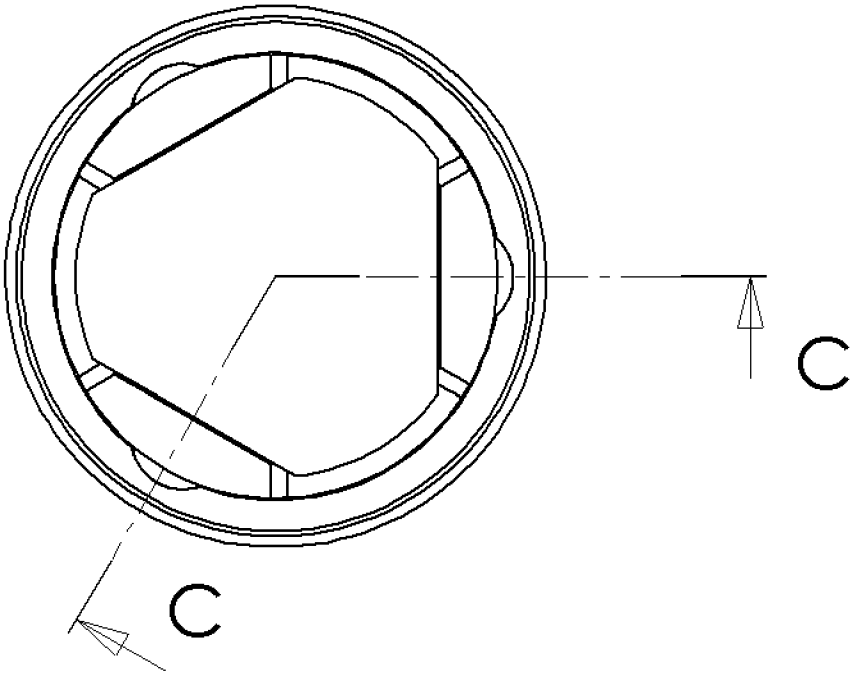
Figure 3 PRIOR ART
FIG. 3 illustrates the plane of the cross-sectional view C-C of the prior art inertial igniter assembly of FIGS. 1 and 2.
Figure 4:
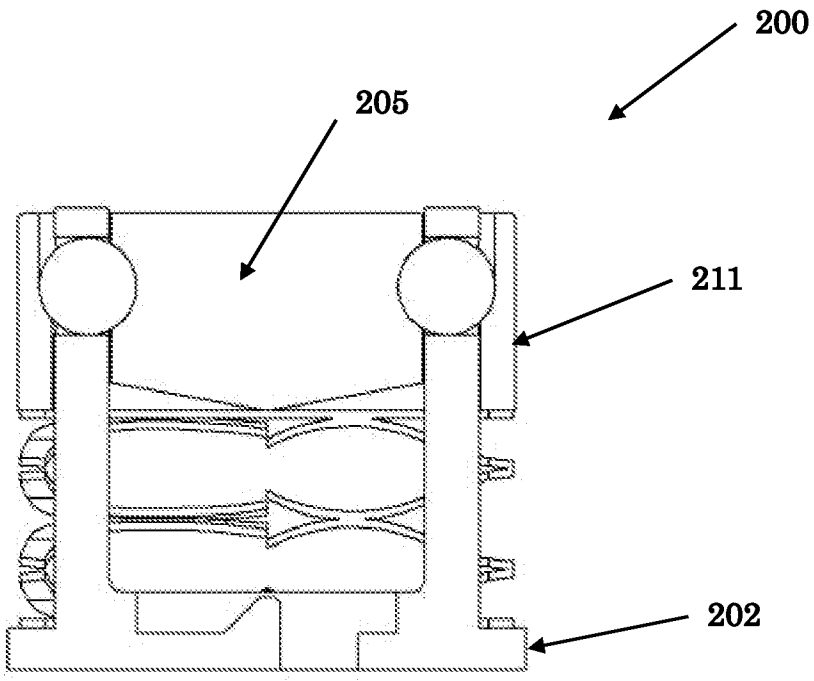
Figure 4 PRIOR ART
FIG. 4 is the view of the C-C cross-section of FIG. 3 of the prior art inertial igniter assembly of FIGS. 1 and 2.
Figure 5:
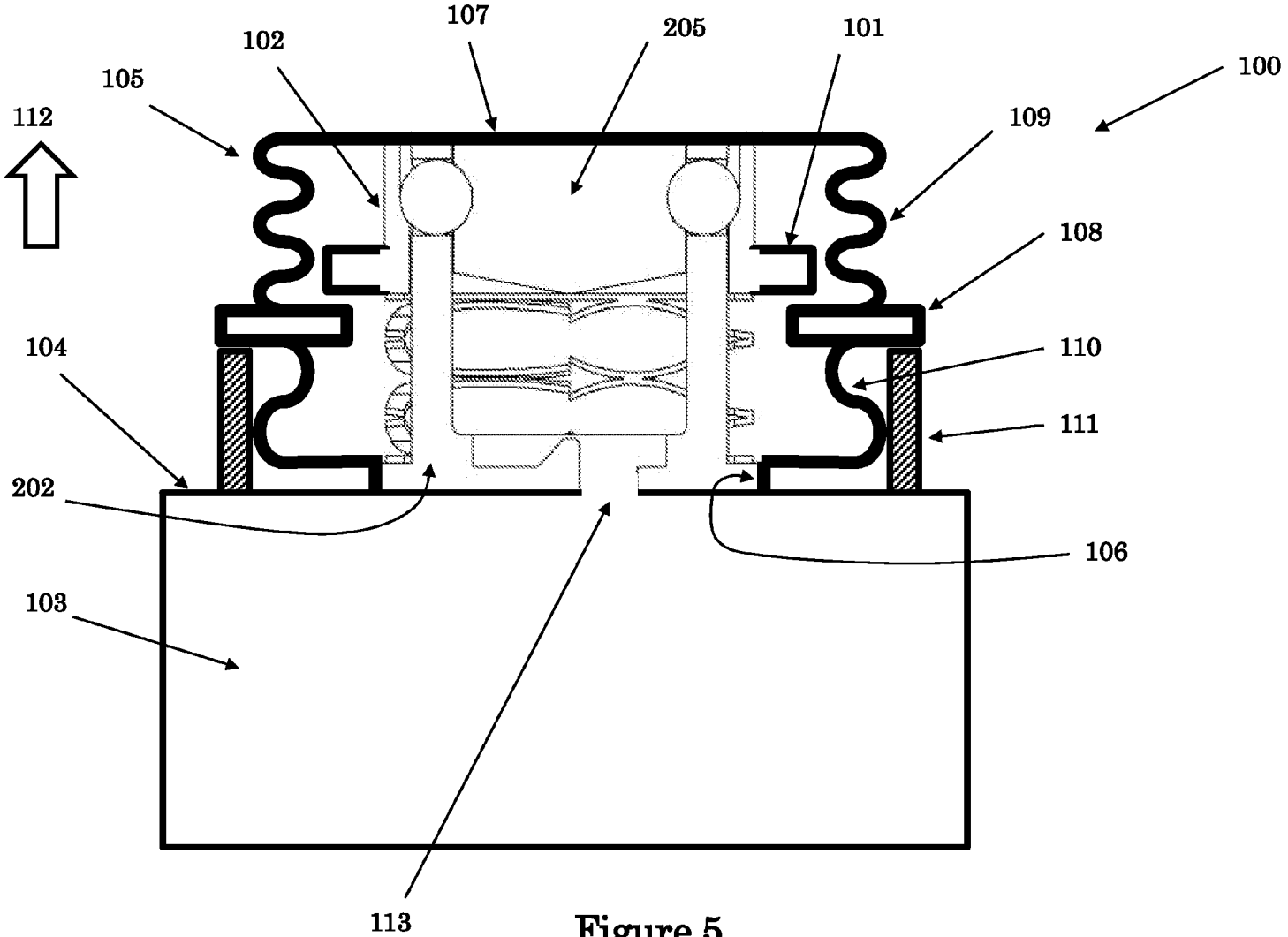
FIG. 5 illustrates the first embodiment of inertial igniter with safing arm (pin) of the present invention as assembled on a thermal battery with the safing arm in position.

The section C-C (FIG. 3) of the inertial igniter of FIGS. 1 and 2 is shown in FIG. 4. The schematic of the first embodiment 100 of inertial igniter with safing arm (pin) as attached to a thermal battery 103 is shown in FIG. 5. The inertial igniter uses the basic inertial igniter 200 of FIGS. 1 and 2, the cross-sectional C-C (FIG. 3) of which is shown in FIG. 4. In this embodiment of the inertial igniter with safing arm, the mechanical safety (delay) mechanism of the inertial igniter 200 is modified by adding a flange 101 (FIG. 5) to the safety mechanism collar 211 (FIGS. 2 and 4), as shown in FIG. 5 and enumerated as 102. The modified inertial igniter would otherwise function as previously described for the inertial igniter 200 of FIGS. 1 and 2.

The base 202 of the modified inertial igniter 200 shown in the schematic of FIG. 5 is attached and sealed to the top surface 104 of the thermal battery 103. A housing element, such as a "bellow" element 105 is assembled over the modified inertial igniter 200, and is attached and sealed preferably to the side 106 of the base 202 of the modified inertial igniter 200 as shown in the schematic of FIG. 5. Alternatively, the "bellow" element 105 may be attached directly to the top 104 of the thermal battery 103. The "bellow" element 105 thereby forms an enclosed sealed volume within which the modified inertial igniter 200 is positioned. The "bellow" element 105 has an extended rigid ring portion 108, which is positioned between a top elastic portion 109 and a bottom elastic portion 110. The inertial igniter with safing arm embodiment 100 is provided with a (preferably) "U-shaped" safing arm 111, the two prongs of which are shown in the schematic of FIG. 5. The safing arm 111 may be provided with a pulling handle or string (not shown) for ease of removal.

In the "safe" configuration shown in FIG. 5, the safing arm 111 is positioned under the exterior portion of the ring 108, thereby placing the bottom elastic portion 110 of the bellow element 105 in tension and the top elastic portion 109 of the bellow element 105 in compression. As a result, if the inertial igniter 100 and the thermal battery 103 assembly is accelerated (i.e., subjected to shock loading) in any direction including the direction of the inertial igniter activation shown by the arrow 112, the safety mechanism collar 102 can displace downward only until its flange 101 comes into contact with the top surface of the rigid ring 108 of the bellow element 105.

Figure 6:
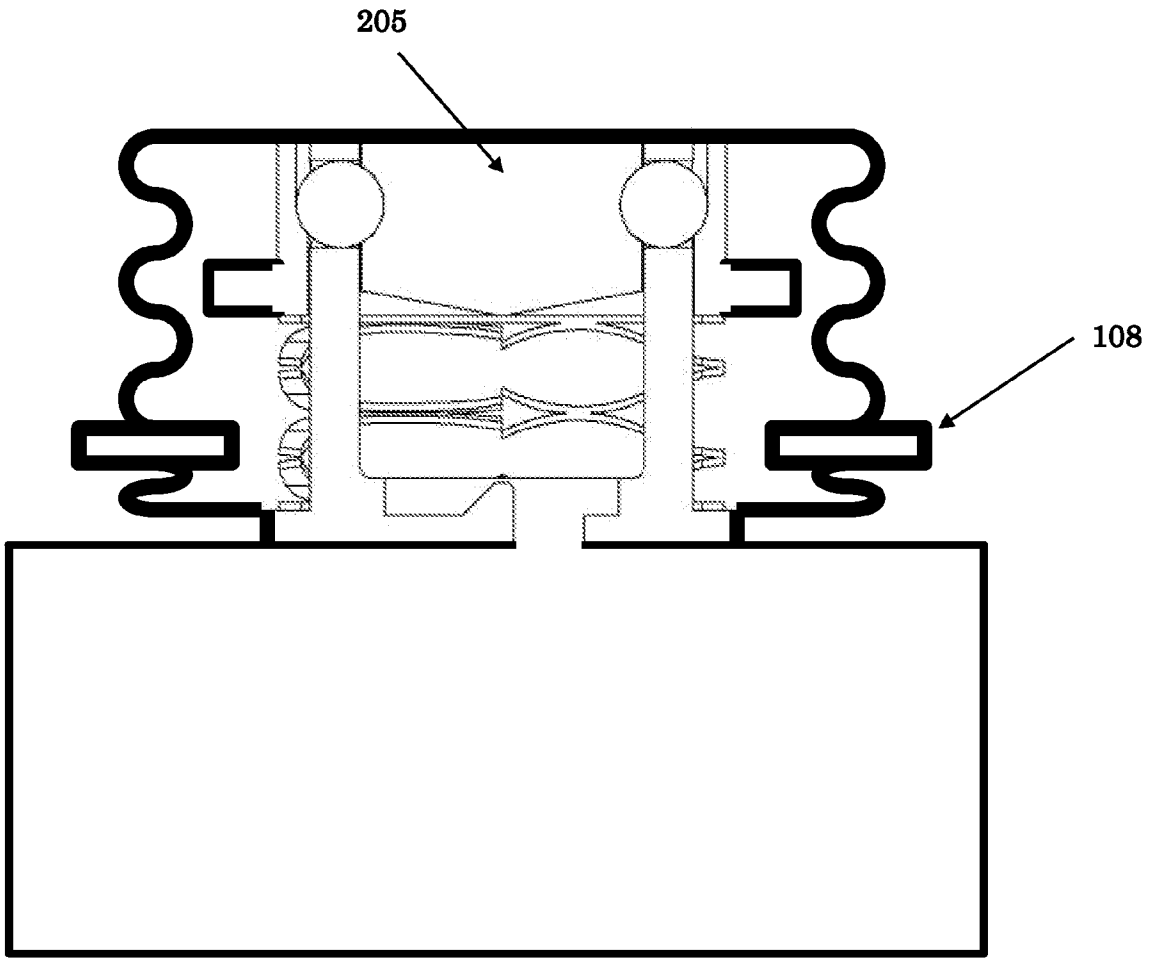
FIG. 6 illustrates the first embodiment of inertial igniter with safing arm (pin) of the present invention as assembled on a thermal battery following the safing arm removal and arming of the inertial igniter.

However, if the safing arm 111 is removed, the bellow 105 returns to its configuration shown in the schematic of FIG. 6. The rigid ring 108 is then moved down to the indicated position in FIG. 6, thereby freeing the safety mechanism collar 102 to travel down when subjected to the specified acceleration time profile (for gun-fired munitions, all-fire setback acceleration), causing the striker mass 205 to be released and activate the inertial igniter pyrotechnic material 215 (FIG. 2) as was previously described for the inertial igniter 200 of FIGS. 1 and 2. The ignition flame and sparks are generally passed through a provided opening (204 in FIG. 2) into the thermal battery 103 through an opening 113 on the surface of its housing (top surface 104 for the thermal battery 103) to activate the thermal battery.

Figure 7:
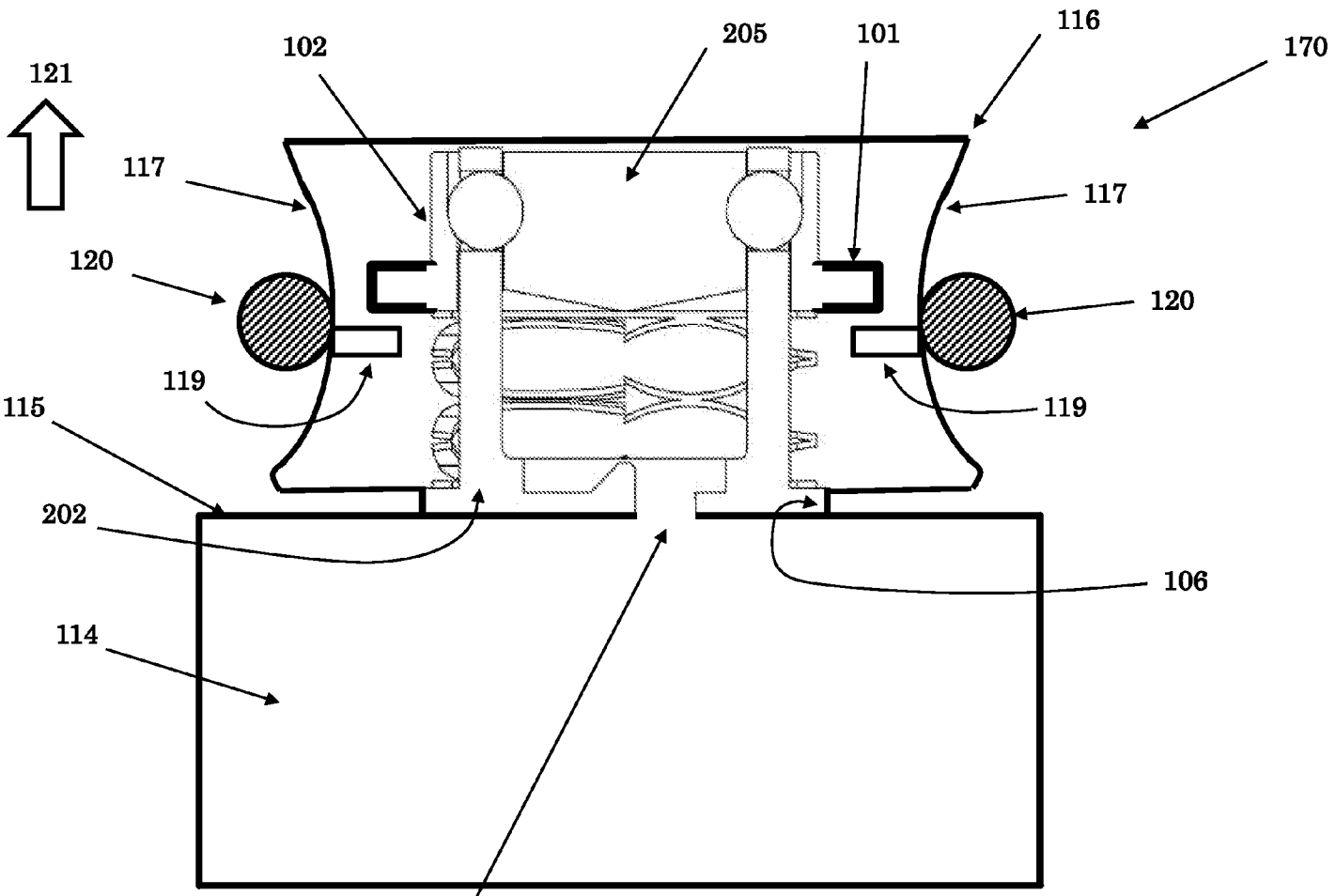
FIG. 7 illustrates a second embodiment of inertial igniter with safing arm (pin) of the present invention as assembled on a thermal battery with the safing arm in position.

The schematic of a second embodiment 170 of inertial igniter with safing arm (pin) as attached to a thermal battery 114 is shown in FIG. 7. The inertial igniter uses the basic inertial igniter 200 of FIGS. 1 and 2, the cross-sectional C-C (FIG. 3) of which is shown in FIG. 4. In the embodiment 170 of the inertial igniter with safing arm, the mechanical safety (delay) mechanism of the inertial igniter 200 is modified as was described for the embodiment 100 of FIG. 5 by adding the flange 101 to the safety mechanism collar 211 (FIGS. 2 and 4), which is enumerated 102 in the schematic of FIG. 7. The modified inertial igniter would otherwise function as previously described for the inertial igniter 200 of FIGS. 1 and 2.

The base 202 of the modified inertial igniter 200 shown in the schematic of FIG. 7 is also attached and sealed to the top surface 115 of the thermal battery 114. A housing element 116 is used to enclose the modified inertial igniter 200, and is attached and sealed preferably to the side 106 of the base 202 of the modified inertial igniter 200 as shown in the schematic of FIG. 7. Alternatively, the housing element 116 may be attached directly to the top 115 of the thermal battery 114. The housing element 116 thereby forms an enclosed sealed volume within which the modified inertial igniter 200 is positioned.

Figure 8:
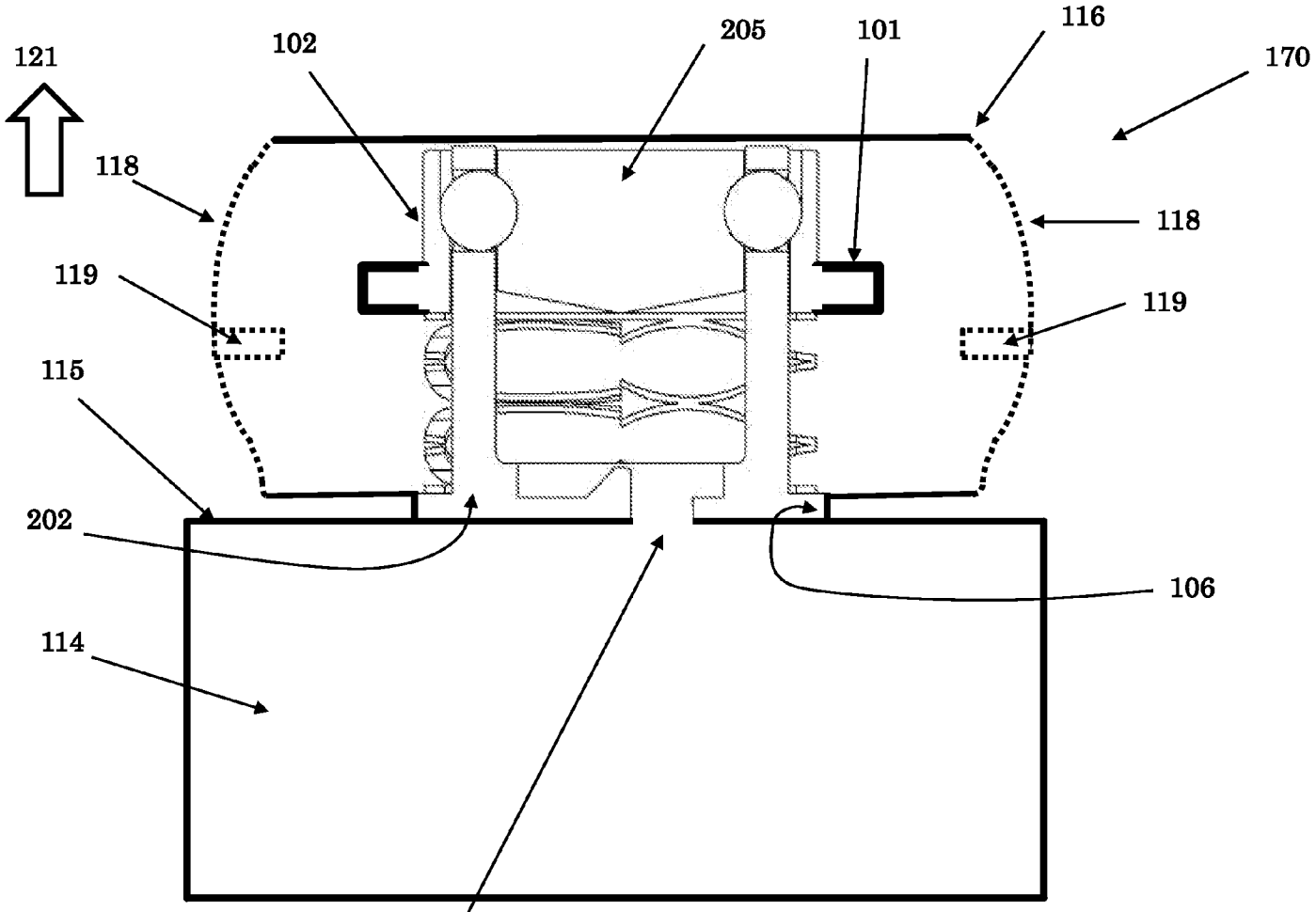
FIG. 8 illustrates the second embodiment of inertial igniter with safing arm (pin) of the present invention as assembled on a thermal battery following the safing arm removal and arming of the inertial igniter.

The housing element 116 is provided with at least one and preferably two laterally flexible and axially relatively rigid curved surface portions 117 on its opposite sides as shown in FIG. 7, which in their free configuration spring out (bulge out) to the positions 118 as shown in FIG. 8. The laterally flexible and axially relatively rigid curved surface portions 117 may, for example, be formed as a section of a sphere or similar curved surface with relatively thin walls out of materials such as stainless steel that is usually used in the construction of bellow type elements. The inner surfaces of the flexible curved surface portions 117 (118 in its free configuration) are provided with relatively rigid stops 119. The inertial igniter with safing arm embodiment 170 is provided with a (preferably) "U-shaped" safing arm 120, the two prongs of which are shown in the schematic of FIG. 7. The safing arm 120 may be provided with a pulling handle or string (not shown) for ease of removal.

In the "safe" configuration shown in FIG. 7, the two prongs of the safing arm 120 are used to press against the laterally flexible and axially relatively rigid curved surface portions 117 to force them into the configuration shown in FIG. 7, in which configuration, the relatively rigid stops 119 are positioned below the flange 101 of the safety mechanism collar 102 as shown in FIG. 7. As a result, if the inertial igniter 170 and the thermal battery 114 assembly is accelerated (i.e., subjected to shock loading) in any direction including the direction of the inertial igniter activation shown by the arrow 121, the safety mechanism collar 102 can displace downward only until its flange 101 comes into contact with the top surface of the relatively rigid stops 119.

However, if the safing arm 120 is removed, the laterally flexible and axially relatively rigid curved surface portions 117 will spring back to its free configuration 118 shown in FIG. 8, and the relatively rigid stops 119 are moved laterally away from the flange 101 of the safety mechanism collar 102 as shown in FIG. 8, thereby freeing the safety mechanism collar 102 to travel down when subjected to the specified acceleration time profile (for gun-fired munitions, all-fire setback acceleration) in the direction of the arrow 121, causing the striker mass 205 to be released and activate the inertial igniter pyrotechnic material 215 (FIG. 2) as was previously described for the inertial igniter 200 of FIGS. 1 and 2. The ignition flame and sparks are generally passed through a provided opening (204 in FIG. 2) into the thermal battery 114 through an opening 122 on the surface of its housing (top surface 115 for the thermal battery 114) to activate the thermal battery.

Figure 9:
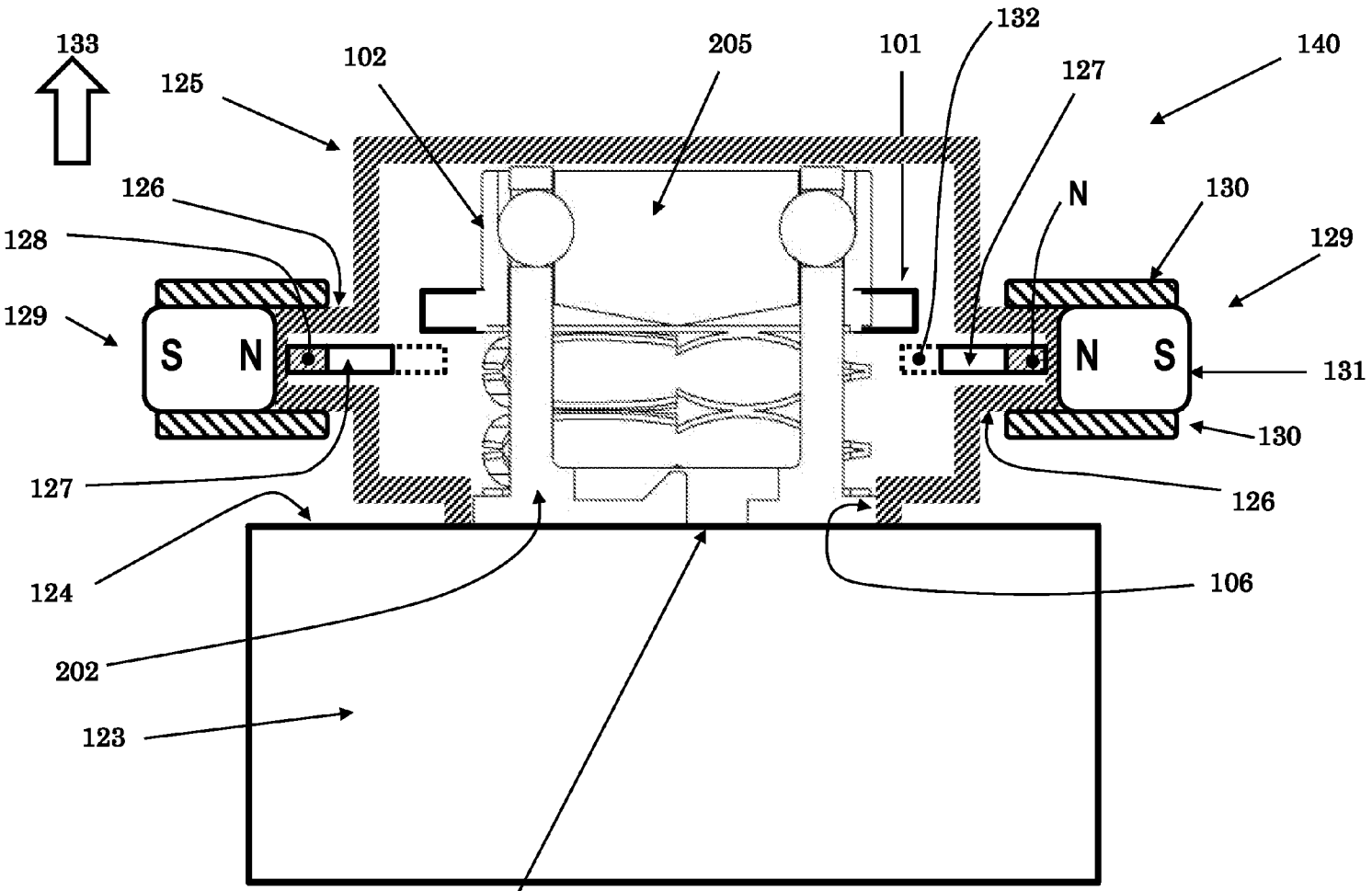
FIG. 9 illustrates a third embodiment of inertial igniter with safing arm (pin) of the present invention as assembled on a thermal battery with the safing arm in position and removed.

The schematic of a third embodiment 140 of inertial igniter with safing arm (pin) as attached to a thermal battery 123 is shown in FIG. 9. The inertial igniter uses the basic inertial igniter 200 of FIGS. 1 and 2, the cross-sectional C-C (FIG. 3) of which is shown in FIG. 4. In the embodiment 140 of the inertial igniter with safing arm, the mechanical safety (delay) mechanism of the inertial igniter 200 is modified as was described for the embodiment 100 of FIG. 5 by adding the flange 101to the safety mechanism collar 211 (FIGS. 2 and 4), which is enumerated 102 in the schematic of FIG. 9. The modified inertial igniter would otherwise function as previously described for the inertial igniter 200 of FIGS. 1 and 2.

The base 202 of the modified inertial igniter 200 shown in the schematic of FIG. 9 is also attached and sealed to the top surface 124 of the thermal battery 123. A housing element 125 is used to enclose the modified inertial igniter 200, and is attached and sealed preferably to the side 106 of the base 202 of the modified inertial igniter 200 as shown in the schematic of FIG. 9. Alternatively, the housing element 125 may be attached directly to the top 124 of the thermal battery 123. The housing element 125 thereby forms an enclosed sealed volume within which the modified inertial igniter 200 is positioned.

The housing element 125 is provided with at least one and preferably two laterally positioned cavities 126 on its opposite sides as shown in FIG. 9. Inside each cavity 126 a translating element 127 is positioned, which is free to move laterally, and which is provided with a spring element (not shown for clarity) that biases the translating element 127 laterally away from the flange 101 of the modified inertial igniter. As a result, the translating element 127 would normally be "pulled" away from the path of downward travel of the safety collar 102 and its flange 101. Each translating element 127 is provided with a magnet element 128, which is oriented such that its N (S), i.e., its North (South), pole is facing the outer surface of the cavity 126.

The inertial igniter with safing arm embodiment 140 is provided with a (preferably) "U-shaped" safing arm 129, the two prongs of which are provided with a "U" shaped end (the sides of which are enumerated 130 in FIG. 9), which engage the outer surface of the cavities 126 as shown in the schematic of FIG. 9. Each prong of the safing arm 129 is also provided with a magnet 131, the N (S) pole of which faces the N (S) pole of the magnet element 128 of the translating element 127. As a result, when the safing arm 129 engages the inertial igniter 140 as shown in FIG. 9, the magnets 131 of the safing arm 129 repulse the magnets 128 of the translating elements 127, thereby pushing the translating elements 127 under the flange 101 of the safety collar 102 (shown in broken lines).

The safing arm 129 may be provided with a pulling handle or string (not shown) for ease of removal.

It is appreciated that since all components of inertial igniters are constructed with nonmagnetic materials, usually stainless steel and brass, therefore they would not interfere with the operation of the disclosed safing arm mechanism of the inertial igniter 140.

In the "safe" configuration shown in FIG. 9, the two prongs of the safing arm 129 position the N pole of the magnets 131 against the outer surfaces of the cavities 126, thereby repelling the facing N pole of the magnet 128 of the translating elements 127, thereby forcing the translating elements 127 towards the inertial igniter body and under the flange 101 of the safety collar 102 as shown with broken lines in FIG. 9 and indicated by the numeral 132. As a result, if the inertial igniter 140 and the thermal battery 123 assembly is accelerated (i.e., subjected to shock loading) in any direction including the direction of the inertial igniter activation shown by the arrow 133, the safety mechanism collar 102 can displace downward only until its flange 101 comes into contact with the top surface of the translating elements 127.

However, if the safing arm 129 is removed, the aforementioned biasing spring (not shown) would return the translating elements 127 to the position shown in solid lines in FIG. 9, i.e., away from under the flange 101 of the safety collar 102, thereby freeing the safety mechanism collar 102 to travel down when subjected to the specified acceleration time profile (for gun-fired munitions, all-fire setback acceleration) in the direction of the arrow 133, causing the striker mass 205 to be released and activate the inertial igniter pyrotechnic material 215 (FIG. 2) as was previously described for the inertial igniter 200 of FIGS. 1 and 2. The ignition flame and sparks are generally passed through a provided opening (204 in FIG. 2) into the thermal battery 123 through an opening 134 on the surface of its housing (top surface 124 for the thermal battery 123) to activate the thermal battery.

Figure 10:
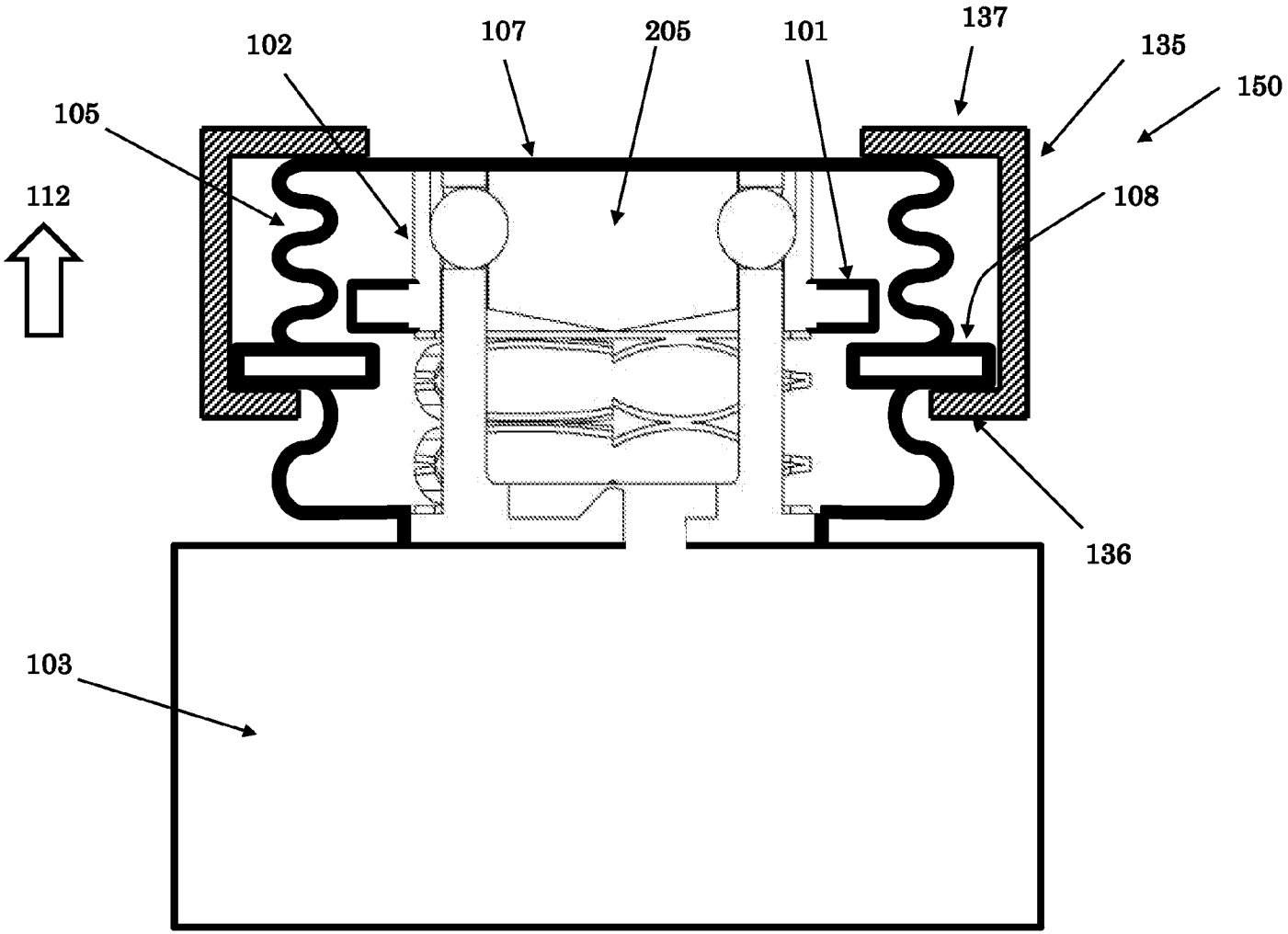
FIG. 10 illustrates an example of the use of different safing arm geometries in the disclosed embodiments of the inertial igniter of the present invention.

It is appreciated by those skilled in the art that the safing arms used in the embodiments of FIGS. 5-9 may have different geometries and that those shown in the illustrations are for presenting the basic operating features of these embodiments without intending to indicate limitation to a single geometrically shaped and operating safing arm. As previously indicated, the function of the safing arm (pin) is to prevent the operation of the safety element (safety collar 102 in the embodiments of FIGS. 5-9). It is appreciated by those skilled in the art that such safing arms (pins) can be designed in various geometries to perform the same function as those shown in said embodiments. For example, the safing arm 111 may be replaced by the safing arm 135 as shown for the embodiment 150 in the schematic of FIG. 10. In the schematic of FIG. 10, the safing arm 135 has "C" shaped ends, the top portion 137 of which engages the top surface 107 of the bellow 105 and the bottom portion 136 of which engages the bottom surface of the rigid ring portion 108 of the bellow 105, thereby preventing the safety collar 102 from moving down enough (in response to accelerations in the direction of the arrow 112) to release the striker mass 205, thereby rendering the inertial igniter 150 non-operational (safe). The inertial igniter is rendered operational with the removal of the safing arm 135 (FIG. 6) as was previously described for the embodiment 100 (FIGS. 5-6).

In the above embodiments of the inertial igniter with safing arm (pin) illustrated in the schematics of FIGS. 5-9, the inertial igniters become operational, i.e., can be initiated when subjected to the prescribed all-fire condition (setback acceleration) if the safing arm (pin) has been removed. In other words, the inertial igniter embodiments of FIGS. 5-9 are "normally operational" and are rendered non-operational (inert) with the insertion of the safing arm (pin).

Alternatively, such inertial igniters may be designed such that they are normally non-operational (inert) and become operational only following insertion of the "safing arm (pin)". Such normally non-operational inertial igniters are particularly useful for applications in which there is a chance that the safing arm of the aforementioned normally operational inertial igniters be accidentally pulled or drop out during transportation, etc. In general, the basic design of any one of the aforementioned normally operational inertial igniters and those that are disclosed below can be readily modified to make them normally non-operational. As examples, such modifications to the normally operational inertial igniter embodiments of FIGS. 7-8 and 9 are described below. It is, however, appreciated by those skilled in the art that such modifications can also be made to any of the disclosed embodiments.

Figure 11:
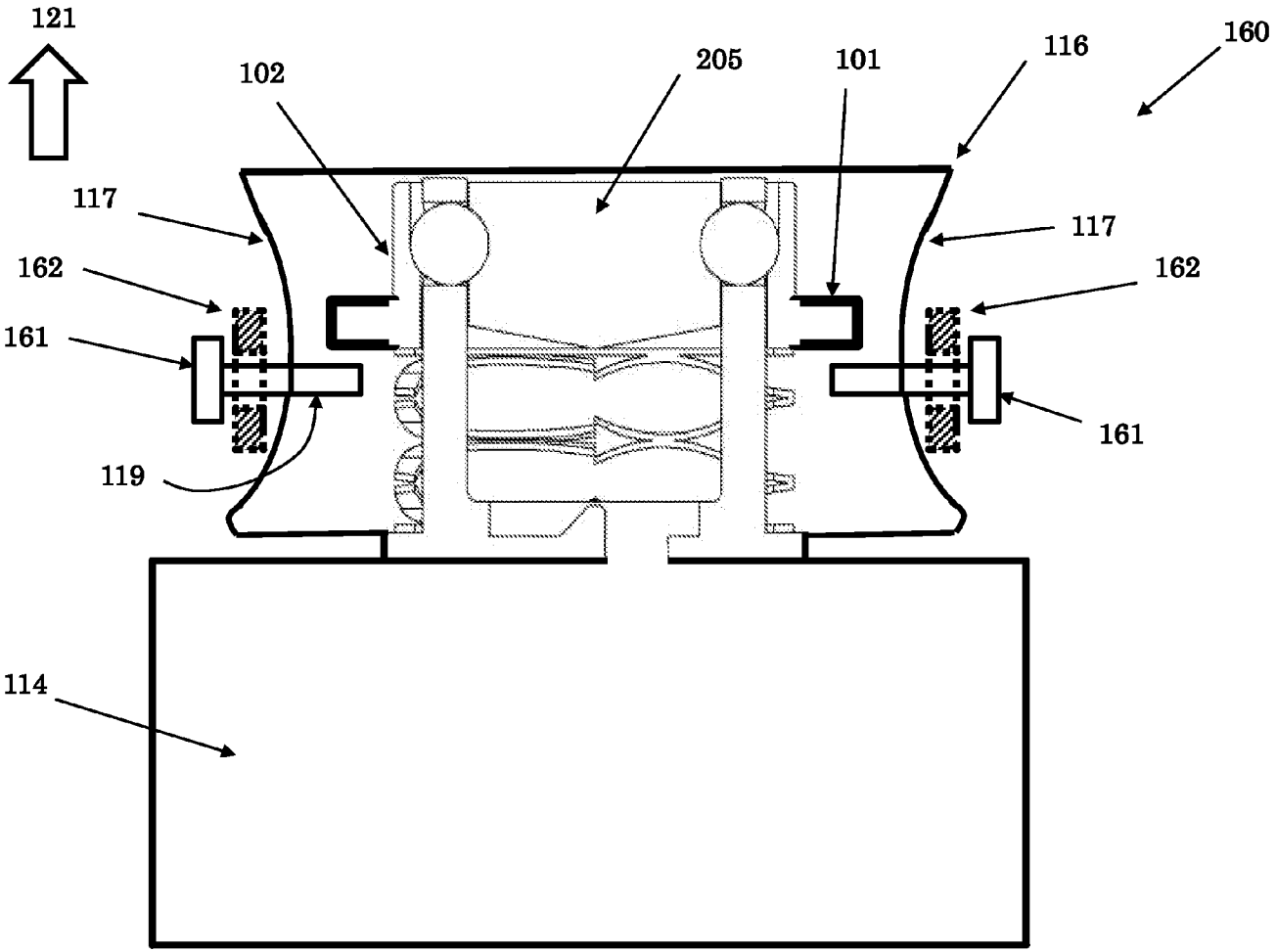
FIG. 11 illustrates one embodiment of a normally non-operational (inert) inertial igniter of the present invention shown in its non-operational state without the inserted arming pin.

The schematic of the inertial igniter embodiment 170 of FIG. 7 without the safing arm 120 as attached to a thermal battery 114 is reconfigured in FIG. 11 and indicated with the numeral 160. Similar to the embodiment 170 of FIG. 7, the housing element 116 which encloses and seals the modified inertial igniter 200 is provided with at least one and preferably two laterally flexible and axially relatively rigid curved surface portions 117 on its opposite sides, which in their free configuration are in the configuration shown in FIG. 11 in contrast to the embodiment 170, in which they are in the configuration shown in FIG. 8. The inner surfaces of the flexible curved surface portions 117 are similarly provided with relatively rigid stops 119. In addition, "T" shaped elements 161 are also provided on the outside surface of the flexible curved surface portions 117, preferably opposite to the inner stops 119 as shown in FIG. 11.

In its free state, the laterally flexible and axially relatively rigid curved surface portions 117 are in the configuration shown in FIG. 11, therefore the relatively rigid stops 119 are positioned below the flange 101 of the safety mechanism collar 102. As a result, if the inertial igniter 160 and the thermal battery 114 assembly is accelerated (i.e., subjected to shock loading) in any direction including the direction of the inertial igniter activation shown by the arrow 121, the safety mechanism collar 102 can displace downward only until its flange 101 comes into contact with the top surface of the relatively rigid stops 119, thereby the striker mass 205 is prevented from being released and cause the inertial igniter to be initiated as was previously described. Thus, in the state shown in FIG. 11, the inertial igniter is non-operational or inert.

Figure 12:
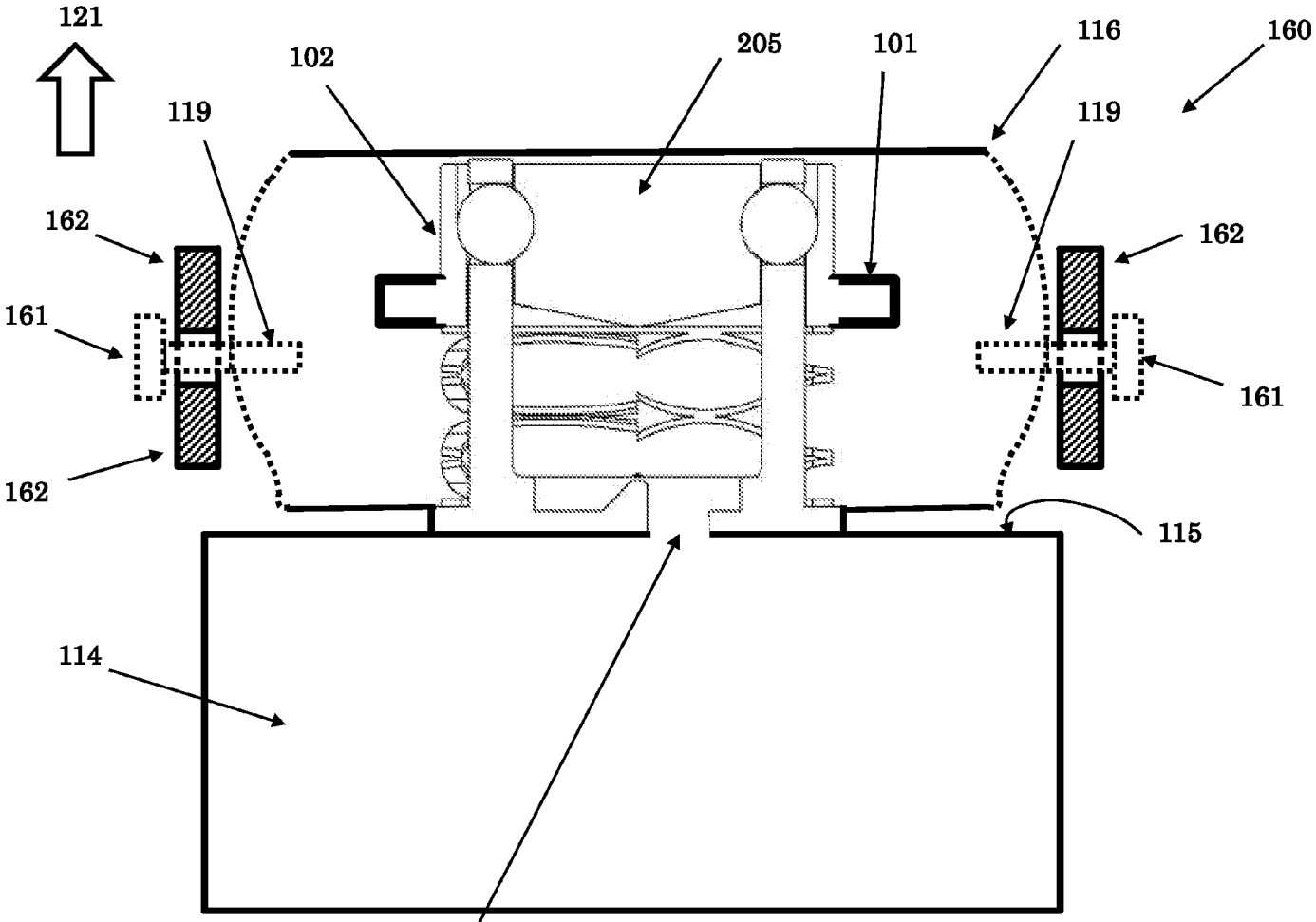
FIG. 12 illustrates the embodiment of the normally non-operational (inert) inertial igniter of FIG. 11 in its armed state with the inserted arming pin.
Figure 13:
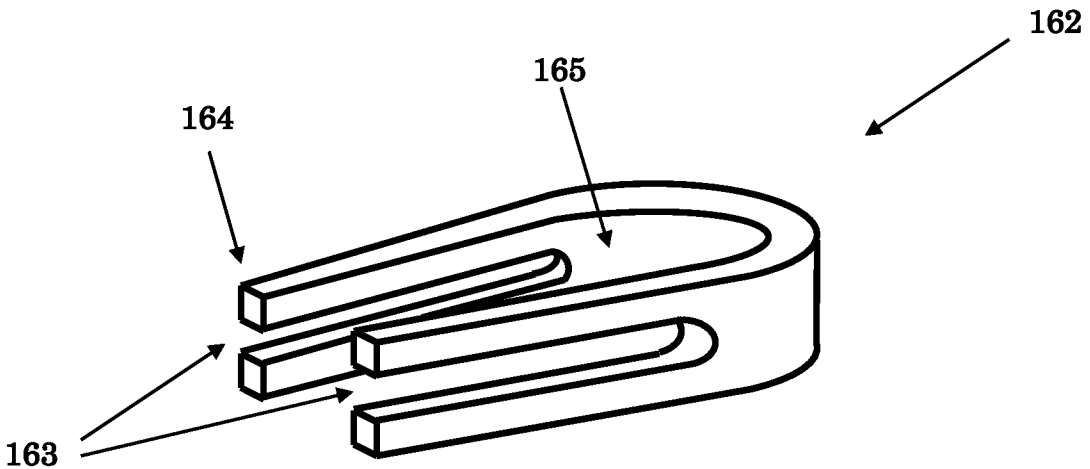
FIG. 13 illustrates an example of a "U" shaped arming pin that can be used to arm the normally non-operational (inert) inertial igniter of FIGS. 11 and 12.

For the normally non-operational (inert) inertial igniter of FIG. 11, the arming pin (arm) 162 is preferably a "U" shaped element similar to the arming pin 162 shown in the schematic of FIG. 13. The arming pin 162 may be provided with a pulling handle or string (not shown) for ease of removal. The "U" shaped arming pin 162 is provided with slots 163 that would engage the "T" shaped elements 161 on outside surface of the flexible curved surface portions 117 as shown with dashed lines in FIG. 11 and solid lines in FIG. 12. The front side 164 of the "U" shaped arming pin 162 is sized to engage the "T" shaped elements 161 on outside surface of the flexible curved surface portions 117 in their position shown in the schematic of FIG. 11 (dashed lines). On the back side 165, the prongs of the "U" shaped arming pin 162 are spaced wider such that as the arming pin 162 engages the "T" shaped elements 161 and is pushed forward against the inertial igniter casing 116, the "T" shaped elements 161 and thereby the opposing flexible curved surface portions 117 are pulled apart, thereby bring them into the configuration shown in dashed lines in FIG. 12.

As a result, with the insertion of the arming pin 162, the laterally flexible and axially relatively rigid curved surface portions 117 are forced to the configuration shown in FIG. 12 with dotted lines, moving the relatively rigid stops 119 laterally away from the flange 101 of the safety mechanism collar 102, thereby freeing the safety mechanism collar 102 to travel down when subjected to the specified acceleration time profile (for gun-fired munitions, all-fire setback acceleration) in the direction of the arrow 121, causing the striker mass 205 to be released and activate the inertial igniter pyrotechnic material 215 (FIG. 2) as was previously described for the inertial igniter 200 of FIGS. 1 and 2. The ignition flame and sparks are generally passed through a provided opening (204 in FIG. 2) into the thermal battery 114 through an opening 122 on the surface of its housing (top surface 115 for the thermal battery 114) to activate the thermal battery.

As another example, the inertial igniter embodiment 140 of FIG. 9, which is a normally operational inertial igniter, i.e., with the safing arm 129 removed, the inertial igniter can be initiated when subjected to the aforementioned prescribed all-fire setback acceleration. The inertial embodiment 140 can be readily turned into a normally non-operational inertial igniter by firstly modifying the biasing spring of the translating element 127 to instead bias the said translating elements 127 laterally towards the flange 101. As a result, with the safing arm 129 removed, the translating elements 127 are in the position indicated by 132 in FIG. 9, and the inertial igniter 140 in non-operational (inert). The second required modification is the switching of the N pole of the magnet 131 with its S pole (or placing the S pole of the magnet attached to the translating element instead of its N pole to face the magnet 131 of the safing arm 129). As a result, when the safing arm 129 (in this case the arming arm or pin 129) is positioned on the inertial igniter 140 as shown in the schematic of FIG. 9, then the translating elements 127 are pulled away from under the flange 101of the safety collar 102, thereby rendering the inertial igniter operational.

In the embodiments of FIGS. 5-12, translating elements (vertically translating element 108 in the embodiment 100 of FIG. 5; and laterally translating elements 119 and 127 in the embodiments of FIG. 7 and FIGS. 9 and 11, respectively) are used to position these mechanically blocking elements in the path of motion of the safety element (collar in the present embodiments) to prevent the release of the striker mass that function to initiate the igniter pyrotechnic material. It is, however, appreciated by those in the art that the mechanically blocking elements may be similarly positioned via mechanisms undergoing other types of motions such as by undergoing rotational motion or flextural bending motion or the like, all actuated similarly by the motion of the bellows, flexural surfaces, magnets, or the like as in the disclosed embodiments of the present invention.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for actuating an inertial igniter, the method comprising:

moving a mass contained within an interior of a body towards one of a pyrotechnic material or primer when an all-fire acceleration profile is experienced;

hermetically sealing an entirety of the interior of the body from an outside environment with a housing element;

restraining the movable mass from contacting the one of the pyrotechnic material or primer when an acceleration profile less than the all-fire acceleration profile is experienced;

providing a blocking to at least indirectly block the movable mass from movement towards the one of the pyrotechnic material or primer when an acceleration profile equal to or greater than the all-fire acceleration profile is experienced, a first portion of the blocking being internal to the housing element and a second portion of the blocking being external to the housing element such that the first portion is movable relative to the second portion; and manually removing the second portion of the blocking external to the housing element relative to the first portion internal to the housing element such that the movable mass can move towards and contact the one of the pyrotechnic material or primer when the all-fire acceleration profile is experienced to actuate the inertial igniter.

2. The method of claim 1, wherein the manually removing the second portion of the blocking comprises removing the second portion from the body to disengage the second portion from the first portion.

3. The method of claim 1, wherein the manually removing the second portion of the blocking comprises moving the second portion on the body from a first position to a second position to disengage the second portion from the first portion.

4. The method of claim 1, wherein the inertial igniter is connected to a thermal battery and the actuation of the inertial igniter produces sparks that are directed into the thermal battery to activate the thermal battery.

5. The method of claim 4, wherein the hermetically sealing comprises sealing the housing element to one of a surface of the body or a surface of the thermal battery.

6. An inertial igniter comprising:

a body;

a housing element hermetically sealed to a surface of the body to seal an entirety of an interior of the body from an outside environment;

a mass movable in the body towards one of a pyrotechnic material or primer when an all-fire acceleration profile is experienced;

a mechanism for restraining the movable mass from contacting the one of the pyrotechnic material or primer when an acceleration profile less than the all-fire acceleration profile is experienced; and a blocking member associated with the housing element for at least indirectly blocking the movable mass from movement towards the one of the pyrotechnic material or primer when an acceleration profile equal to or greater than the all-fire acceleration profile is experienced, a first portion of the blocking member being internal to the housing element and a second portion of the blocking member being external to the housing element such that the first portion is movable relative to the second portion;

wherein the second portion of the blocking member external to the housing element is movable relative to the first portion internal to the housing element such that when the second portion is moved the movable mass can move towards and contact the one of the pyrotechnic material or primer when the all-fire acceleration profile is experienced to actuate the inertial igniter.

7. The inertial igniter of claim 6, wherein the mechanism comprises:

two or more posts along which the mass is movable;

a locking ball associated with at least one of the two or more posts and disposed partially within an opening in the at least one of the two or more posts and partially within a cavity in the mass to restrain the movable mass from contacting the one of the pyrotechnic material or primer when an acceleration profile less than the all-fire acceleration profile is experienced;

a locking collar movable between a restraining position for retaining the locking ball partially within the cavity in the mass and an actuation position where the locking ball is no longer retained in the cavity; and a biasing spring for biasing the locking collar in the restraining position and for allowing the collar to move to the actuation position when the all-fire acceleration profile is experienced.

8. The inertial igniter of claim 7, further comprising:

the locking collar including a flange;

the housing element comprises a bellows body member to at least partially envelop the mechanism, the bellows body member including the first portion being positioned to divide the bellows member into first and second bellows portions, the first portion having an internal portion internal to the bellows body and an external portion external to the bellows body; and the second portion comprises a safing arm disposed to engage the external portion of the first portion such that the first bellows portion of the bellows member is compressed and the second bellows portion of the bellows member is elongated with movement of the collar being blocked due to engagement of the internal portion of the first portion with the flange;

wherein removal of the safing arm causes the first bellows portion to bias the internal portion of the first portion to move out of engagement with the flange allowing the collar to move to the actuation position when the all-fire acceleration profile is experienced.

9. The inertial igniter of claim 7, further comprising:

the locking collar including a flange;

the housing element to at least partially envelop the mechanism, the housing element including at least a first wall biased into a first position;

the first portion being disposed on the at least first wall such that the first portion engages the flange when the at least first wall is retained in a second position; and wherein the second portion comprises a safing arm disposed to retain the at least first wall in the second position;

wherein removal of the safing arm moves the at least first wall from the second position to the first position to allow the first portion to move out of engagement with the flange allowing the collar to move to the actuation position when the all-fire acceleration profile is experienced.

10. The inertial igniter of claim 7, further comprising:

the locking collar including a flange;

the housing element to at least partially envelop the mechanism, the housing element including at least a first wall;

the first portion movably disposed relative to the at least first wall such that the first portion engages the flange when the first portion is retained in a first blocking member position; and wherein the second portion comprises a safing arm movable between first and second safing arm positions, wherein the safing arm is disposed in the first safing arm position to retain the at least one wall in the first safing arm position;

wherein movement of the safing arm from the first safing arm position to the second safing arm position moves the first portion from the first blocking member position to a second blocking member position out of engagement with the flange allowing the collar to move to the actuation position when the all-fire acceleration profile is experienced.

11. The inertial igniter of claim 6, further comprising a thermal battery such that actuation of the inertial igniter produces sparks that are directed into the thermal battery to activate the thermal battery.

12. A thermal battery apparatus comprising:

an inertial igniter comprising:

a body;

a mass movable in the body towards one of a pyrotechnic material or primer when an all-fire acceleration profile is experienced;

a mechanism for restraining the movable mass from contacting the one of the pyrotechnic material or primer when an acceleration profile less than the all-fire acceleration profile is experienced; and a blocking member associated with a housing element for at least indirectly blocking the movable mass from movement towards the one of the pyrotechnic material or primer when an acceleration profile equal to or greater than the all-fire acceleration profile is experienced, a first portion of the blocking member being internal to the housing element and a second portion of the blocking member being external to the housing element such that the first portion is movable relative to the second portion;

wherein the second portion of the blocking member external to the housing element is movable relative to the first portion internal to the housing element such that when the second portion is moved the movable mass can move towards and contact the one of the pyrotechnic material or primer when the all-fire acceleration profile is experienced to actuate the inertial igniter;

a thermal battery operatively connected to the body such that actuation of the inertial igniter produces sparks that are directed into the thermal battery to activate the thermal battery; and the housing element is hermetically sealed to one of a surface of the inertial igniter or a surface of the thermal battery to seal an entirety of an interior of the body from an outside environment.

13. The thermal battery apparatus of claim 12, wherein the mechanism comprises:

two or more posts along which the mass is movable;

a locking ball associated with at least one of the two or more posts and disposed partially within an opening in the at least one of the two or more posts and partially within a cavity in the mass to restrain the movable mass from contacting the one of the pyrotechnic material or primer when an acceleration profile less than the all-fire acceleration profile is experienced;

a locking collar movable between a restraining position for retaining the locking ball partially within the cavity in the mass and an actuation position where the locking ball is no longer retained in the cavity; and a biasing spring for biasing the locking collar in the restraining position and for allowing the collar to move to the actuation position when the all-fire acceleration profile is experienced.

14. The inertial igniter of claim 13, further comprising:

the locking collar including a flange;

the housing element comprises a bellows body member to at least partially envelop the mechanism, the bellows body member including the first portion being positioned to divide the bellows member into first and second bellows portions, the first portion having an internal portion internal to the bellows body and an external portion external to the bellows body; and the second portion comprises a safing arm disposed to engage the external portion of the first portion such that the first bellows portion of the bellows member is compressed and the second bellows portion of the bellows member is elongated with movement of the collar being blocked due to engagement of the internal portion of the first portion with the flange;

wherein removal of the safing arm causes the first bellows portion to bias the internal portion of the first portion to move out of engagement with the flange allowing the collar to move to the actuation position when the all-fire acceleration profile is experienced.

15. The inertial igniter of claim 13, further comprising:

the locking collar including a flange;

the housing element to at least partially envelop the mechanism, the housing element including at least a first wall biased into a first position;

the first portion being disposed on the at least first wall such that the first portion engages the flange when the at least first wall is retained in a second position; and wherein the second portion comprises a safing arm disposed to retain the at least first wall in the second position;

wherein removal of the safing arm moves the at least first wall from the second position to the first position to allow the first portion to move out of engagement with the flange allowing the collar to move to the actuation position when the all-fire acceleration profile is experienced.

16. The inertial igniter of claim 13, further comprising:

the locking collar including a flange;

the housing element to at least partially envelop the mechanism, the housing element including at least a first wall;

the first portion movably disposed relative to the at least first wall such that the first portion engages the flange when the first portion is retained in a first blocking member position; and wherein the second portion comprises a safing arm movable between first and second safing arm positions, wherein the safing arm is disposed in the first safing arm position to retain the at least one wall in the first safing arm position;

wherein movement of the safing arm from the first safing arm position to the second safing arm position moves the first portion from the first blocking member position to a second blocking member position out of engagement with the flange allowing the collar to move to the actuation position when the all-fire acceleration profile is experienced.

* * * * *